US010570757B2

(12) United States Patent
De Gaillard et al.

(10) Patent No.: US 10,570,757 B2
(45) Date of Patent: Feb. 25, 2020

(54) ROTARY ASSEMBLY OF A TURBOMACHINE EQUIPPED WITH AN AXIAL RETENTION SYSTEM OF A BLADE

(71) Applicant: Safran Aircraft Engines, Paris (FR)

(72) Inventors: Thomas Alain De Gaillard, Moissy-Cramayel (FR); Alexandre Bernard Marie Boisson, Moissy-Cramayel (FR); Gilles Pierre-Marie Notarianni, Moissy-Cramayel (FR); Charles-Henri Claude Jacky Sullet, Moissy-Cramayel (FR)

(73) Assignee: Safran Aircraft Engines, Paris (FR)

( * ) Notice: Subject to any disclaimer, the term of this patent is extended or adjusted under 35 U.S.C. 154(b) by 175 days.

(21) Appl. No.: 15/787,838

(22) Filed: Oct. 19, 2017

(65) Prior Publication Data

US 2018/0112545 A1 Apr. 26, 2018

(30) Foreign Application Priority Data

Oct. 21, 2016 (FR) ..... 16 60237

(51) Int. Cl.
*F01D 5/32* (2006.01)
*F01D 5/30* (2006.01)
(Continued)

(52) U.S. Cl.
CPC ..... *F01D 5/326* (2013.01); *F01D 5/3007* (2013.01); *F01D 5/323* (2013.01); *F01D 5/02* (2013.01);
(Continued)

(58) Field of Classification Search
CPC ..... F01D 5/326; F01D 5/323; F01D 5/3007; F01D 5/02; F01D 5/12; F05D 2220/36; F05D 2230/60; F05D 2260/30
(Continued)

(56) References Cited

U.S. PATENT DOCUMENTS 2,949,278 A * 8/1960 McCormick ..... F01D 5/326 416/193 A
3,501,249 A * 3/1970 Scalzo ..... F01D 5/081 416/95
(Continued)

FOREIGN PATENT DOCUMENTS

FR 2 974 864 A1 11/2012
FR 3 033 180 A1 9/2016

OTHER PUBLICATIONS

Preliminary Search Report dated Jul. 3, 2017 in French Patent Application No. FR1660237, with English translation of category of cited documents, 8 pages.

*Primary Examiner* — J. Todd Newton
(74) *Attorney, Agent, or Firm* — Oblon, McClelland, Maier & Neustadt, L.L.P.

(57) ABSTRACT

A turbomachine rotary assembly includes a plurality of blades having roots positioned in the grooves of a rotor disk and an axial retention system of the blades. The axial retention system includes a removable lock mounted bearing against the upstream axial ends of two consecutive teeth of the disk so as to block the opening of the groove formed by the teeth. It includes removable parts suitable for being mounted at the upstream axial ends of the teeth and to block the lock by clamping the lock between the removable parts and the teeth once the lock is installed against the upstream axial ends of the teeth.

9 Claims, 3 Drawing Sheets

Figure 1:
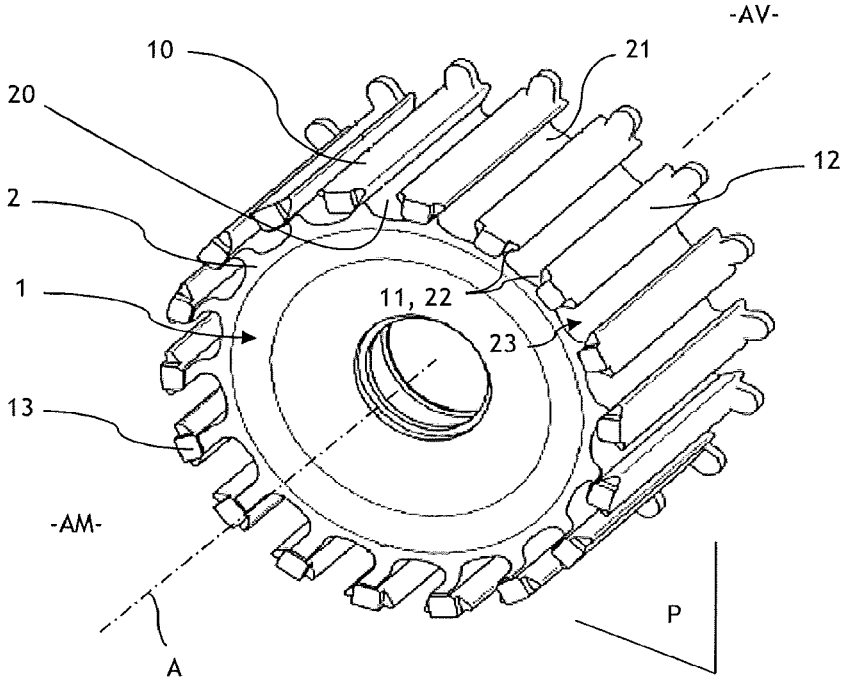

(51) Int. Cl.
*F01D 5/02* (2006.01)
*F01D 5/12* (2006.01)

(52) U.S. Cl.
CPC ..... *F01D 5/12* (2013.01); *F05D 2220/36* (2013.01); *F05D 2230/60* (2013.01); *F05D 2260/30* (2013.01)

(58) Field of Classification Search
USPC ..... 416/220 R
See application file for complete search history.

(56) References Cited

U.S. PATENT DOCUMENTS 3,644,058 A * 2/1972 Barnabei ..... F01D 5/081 416/95
3,748,060 A * 7/1973 Hugoson ..... F01D 5/081 416/92
4,033,705 A * 7/1977 Luebering ..... F01D 5/3015 416/220 R
4,405,285 A * 9/1983 Surdi ..... F01D 5/326 411/107
4,478,554 A * 10/1984 Surdi ..... F01D 5/323 416/220 R
4,502,841 A * 3/1985 Kebedjis ..... F01D 5/326 416/220 R
4,659,285 A * 4/1987 Kalogeros ..... F01D 5/3015 416/220 R
4,778,342 A * 10/1988 Conlow ..... F01D 5/323 416/193 A
4,872,810 A * 10/1989 Brown ..... F01D 5/22 416/145
5,161,951 A * 11/1992 Hackstie ..... F01D 5/025 416/204 A
5,259,728 A * 11/1993 Szpunar ..... F01D 5/3007 416/2
5,263,823 A * 11/1993 Cabaret ..... F01D 11/006 416/218
5,282,720 A * 2/1994 Szpunar ..... F01D 5/323 416/220 R
5,350,279 A * 9/1994 Prentice ..... F01D 5/323 416/220 R
5,582,077 A * 12/1996 Agram ..... F01D 5/027 403/318
5,993,160 A * 11/1999 Bouchard ..... F01D 5/3015 416/193 A
6,457,942 B1 * 10/2002 Forrester ..... F01D 5/326 416/220 R
6,561,764 B1 * 5/2003 Tiemann ..... F01D 5/3015 416/193 A
6,634,863 B1 10/2003 Forrester et al.
8,899,935 B2 * 12/2014 Buisson ..... F04D 29/322 416/220 R
9,422,818 B2 * 8/2016 Blanchard ..... F01D 5/3069
9,441,494 B2 * 9/2016 Marlin ..... F01D 5/323
10,018,065 B2 * 7/2018 Vogel ..... F01D 5/187
10,371,163 B2 * 8/2019 Bishop ..... F01D 5/3015
2007/0297908 A1 * 12/2007 Barber ..... F01D 5/3038 416/220 R
2008/0226458 A1 9/2008 Pierrot et al.
2009/0226321 A1 * 9/2009 Buisson ..... F01D 5/326 416/220 R
2009/0324414 A1 * 12/2009 Helmis ..... F01D 5/3015 416/220 R
2013/0323067 A1 * 12/2013 Antonellis ..... F01D 5/3015 416/223 R
2014/0133991 A1 * 5/2014 Anderson ..... F01D 5/3015 416/220 R
2015/0369063 A1 * 12/2015 Fohrigen ..... F01D 5/3015 416/220 R
2018/0179904 A1 * 6/2018 Jung ..... F01D 5/3015
2019/0078454 A1 * 3/2019 Rudolph ..... F01D 11/006

* cited by examiner

ROTARY ASSEMBLY OF A TURBOMACHINE EQUIPPED WITH AN AXIAL RETENTION SYSTEM OF A BLADE

FIELD OF THE INVENTION

The present invention relates to a rotary assembly of a turbomachine equipped with an axial retention system of one or more of its blades, in particular of the blades of a rotor disk of a turbojet.

PRIOR ART

The general structure of a rotary assembly of a turbomachine in the field of aeronautics is well known to a person skilled in the art.

Such a rotary assembly generally comprises one or more rotors, the rotor disk whereof is connected to a rotating shaft of the rotor, said rotor shaft has at its periphery a circumferential alternation of cells, generally called grooves, and teeth, with substantially axial orientations, i.e., extending in a direction parallel to the axis of the rotor shaft.

The rotor disk is equipped with a plurality of blades partially inserted into grooves and extending radially, from the periphery of the disk, into a stream of fluid feeding the turbomachine.

In the particular case of a rotary assembly of a fan, the blades of the fan extend radially in a stream extending to the inner wall of a fan casing connected to an annular nacelle to delimit this stream on the outside.

It is specified that the term "axial" refers to the (longitudinal) axis of rotation of the rotor. The term "radial" refers to a radius of the rotor disk, the latter extending by definition orthogonally to the axis of rotation of the rotor. The term "circumferential" refers to the circumference of the rotor disk, and corresponds to the rotational path of the rotor disk.

It is also specified that the term "upstream" (AM) corresponds to an area of origin of the fluid which passes through the turbomachine during operation, and that the term "downstream" (AV) corresponds to a departure area of this fluid. Thus, the fluid passes through the turbomachine, and in particular the rotor disk, from upstream to downstream.

Moreover, for the purpose of their retention, the blades each have at their end a root engaged axially in the grooves of the disk and retained radially by the teeth of the disk. A wedge is typically interposed between each blade root and the bottom of the corresponding groove for the purpose of retaining, a priori with pre-loading, these elements. The blades are secured and retained upstream particularly by an upstream cone connected to the disk. This cone constitutes the inner and upstream limit of the circulation stream of the gases of the turbomachine. The turbojet further comprises an upstream shroud, integral with the disk and the upstream cone, and situated between the disk and the upstream cone along the axis of the turbomachine. The shroud thus allows the upstream cone to be connected to the disk.

Generally, a lock may conventionally be provided so as to secure axially the blades in their grooves. Referring to document FR2974864, illustrating the state of the art for mounting such a lock, the lock is positioned in slots provided for this purpose in the teeth of the disk, the lock being in correspondence with a groove of the disk in which a blade root has previously been inserted. In conformity with the embodiment of FIG. 4 and of FIG. 5 of this document, the lock is immobilized via the upstream shroud attached to the disk, this shroud blocking axially a wedge interposed between each blade root and the bottom of the corresponding groove. The lock is inserted into its slots by radial translation oriented toward the outside of the disk.

U.S. Pat. No. 6,634,863 describes a lock of this type inserted in a groove. It describes more precisely a turbine engine assembly comprising a disk the blades whereof are retained axially by a retention assembly (lock) inserted into a housing provided in the inner wall of the teeth of the disk, and extending perpendicularly to the axis of the groove accommodating the root of the blade. The retention element is coupled to a spacing element positioned in the groove, supported on the lower surface of said groove, and allows avoiding having the blades pivoting on themselves in the groove.

In the foregoing, it is understood that it is necessary to reserve a radial space at the disk pin of the rotor, i.e. at its external portion, so as to allow the insertion or the removal of the lock in its notch by radial translation as described previously. This space is situated under the lock, i.e. closer to the center of the disk, when said lock is in place in its notch.

Yet the necessity of providing such a space causes manufacturing constraints of the rotor disk, and most particularly constraints in placing the attachment element allowing the disk to be connected to the upstream shroud, the latter connecting the disk and the upstream cone. In fact, the attachment element allowing the shroud to connect to the disk must necessarily be positioned under the space reserved for the radial displacement of the lock (i.e. even closer to the center of the disk). Moreover, the radial space necessary for the insertion or the withdrawal of the lock by radial translation is unfavorable for reducing the diameter of the disk at its free upstream end at its teeth, to the detriment of freedom of choice of the aerodynamic profile and of the diameter of the upstream shroud and of the upstream cone.

PRESENTATION OF THE INVENTION

The invention therefore has as its aim to correct the disadvantages of the prior art by proposing a turbomachine rotary assembly provided with an axial retention system of a blade, such a retention system comprising a lock blocking the opening of a groove in which is inserted a blade, and the installation and/or removal whereof is not accomplished by radial translation of said lock particularly into/from a notch provided for this purpose.

The retention system according to the invention must also consequently allow the space usually provided for allowing the insertion or the withdrawal of the lock in its notch to be made usable, so as to reduce certain manufacturing constraints of the disk, and in particular the manufacturing constraints connected with the placement on the disk of the attachment between the shroud and the disk.

To this end, another aim of the invention is to propose a turbomachine rotary assembly equipped with the previous retention system, wherein the attachment of the shroud to the disk is positioned in the space usually necessary for the insertion or the removal of the lock, so that the shroud-disk attachment is positioned higher on the disk pin, at the periphery of the disk, i.e. more distant radially from the center of the rotor disk.

The installation and the removal of the retention system should advantageously be accomplished rapidly and simply.

Another aim of the invention is to propose a turbojet comprising such a rotating assembly.

The invention also aims to propose a mounting method of the foregoing retention system to a rotary assembly of a turbomachine to retain axially one or more of its blades.

To this end, the invention relates to a turbomachine rotary assembly, comprising:

a rotor disk comprising circumferentially an alternation of peripheral teeth and grooves, said grooves being provided with an opening bordered by the ends of the teeth, a plurality of blades having roots positioned in the grooves, the turbomachine rotary assembly further comprising at least an axial retention system of said blades, and being mainly characterized in that the axial retention system comprises a removable lock mounted bearing against the upstream axial ends of two consecutive teeth of the disk so as to block the opening of the groove formed by said teeth, and in that said axial retention system includes removable parts suitable for being mounted at the upstream axial ends of the teeth and to block the lock by tightening said lock between said removable parts and the teeth once the lock is installed against the upstream axial ends of the teeth.

Optionally, the rotary assembly according to the invention may comprise the following features:

the removable parts have a shape corresponding to the shape of the ends of the teeth on which they are mounted, so as to continuously prolong the teeth;

the removable parts are mounted at the ends of the teeth by screwing;

the removable lock is in the form of a part having a central portion blocking the opening of the groove, and side edges designed to be clamped by the ends of the teeth and the removable parts;

the rotor disk being of the pin-shaped type, in that it comprises a pin of said disk having a curved pin-head shaped profile which extends radially in the upstream direction from the axis of the disk, the removable parts protrudes from the rotor disk and are vertically in line with a prominence of the disk pin. This pin-head shaped curved profile is a substantially C-shaped profile comprising an exterior axial arm which delimits the teeth of the disk, an interior arm which extends substantially axially on at least one component closer to the engine axis than the exterior arm, and a front connecting arm with a radial component, which conventionally comprises said prominence;

the disk pin is provided at its prominence with an attachment element of a shroud to the disk, preferably being in the form of a hook, so that the lock is mounted vertically in line with the attachment element of the shroud to the disk;

advantageously, between the prominence of the disk pin and the teeth, the disk pin has no space for insertion and/or removal of the lock;

the rotary assembly further comprises a wedge designed to be positioned in the groove, between the bottom of the groove and the blade root, so as to retain the sides of the blade root bearing against the edges of the groove.

Another object of the invention relates to a turbomachine comprising one or more rotary assembly(ies) comprising at least one axial retention system of a blade of the rotor disk previously described.

Another object of the invention relates to a mounting method of an axial retention system of a blade on a turbomachine rotary assembly as described previously, the rotary assembly comprising a rotor disk provided circumferentially with an alternation of peripheral teeth and grooves, said grooves being provided with an opening bordered by the ends of the teeth, and at least one blade the root whereof is inserted in a groove, the mounting method being mainly characterized in that it comprises:

the mounting of a lock bearing against the ends of the teeth, so as to block the opening of the groove, the mounting of the removable parts at the ends of the teeth so as to block the lock by clamping said lock between said removable parts and the teeth.

Figure 2A:
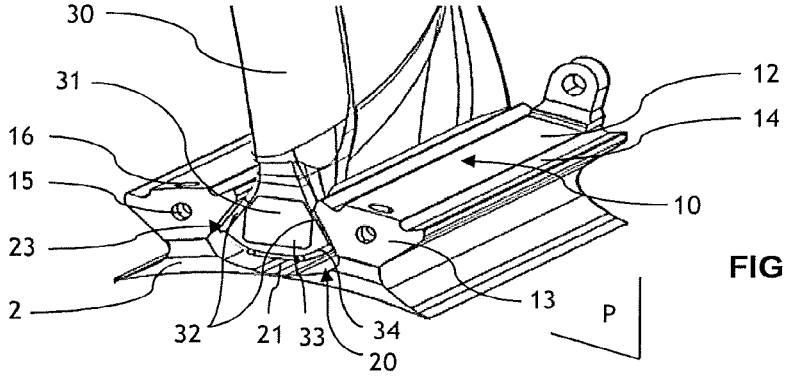
Figure 2B:
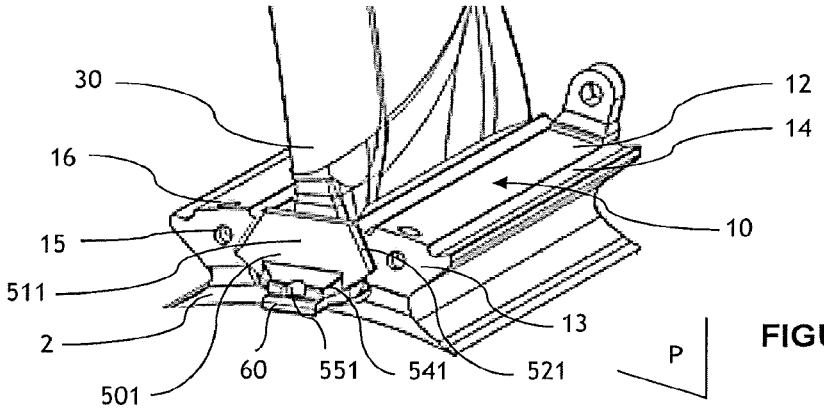
Figure 2C:
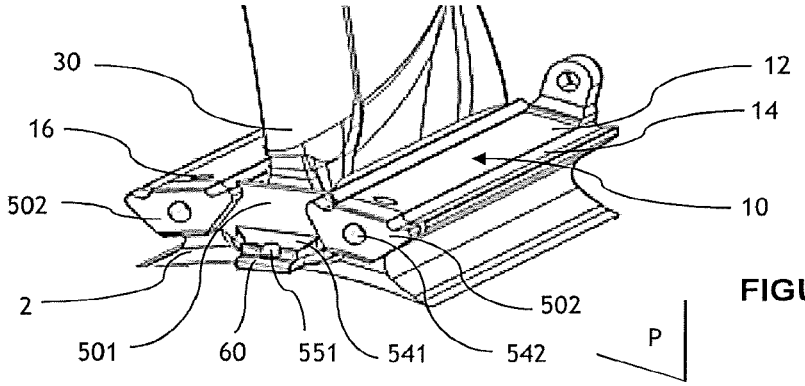
Figure 3:
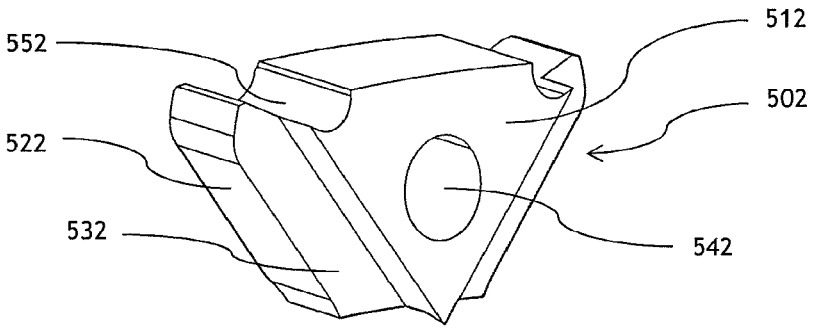
Figure 4:
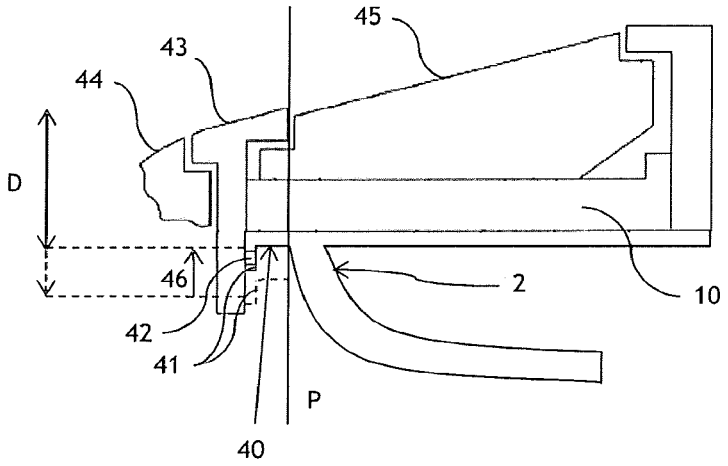

Other advantages and features of the invention will appear upon reading the following description given by way of an illustrative and not limiting example, with reference to the appended figures which show:

FIG. 1, a perspective view of a rotor disk;

FIGS. 2A, 2B and 2C illustrating the mounting of the axial retention system of a blade, according to the invention, FIG. 3, a perspective view of a removable part of the axial retention system of a blade, according to the invention, FIG. 4, a section view of a rotor disk illustrating an advantage of the invention manifested by a rising of the attachment of the shroud to the rotor disk pin.

DETAILED DESCRIPTION OF THE INVENTION

The invention relates to a rotary assembly of a turbomachine, and in particular to a turbojet, equipped with an axial retention system of at least one blade of a rotor disk. It is for example, but not exclusively, a fan disk of a turbojet, said fan being positioned upstream of a compressor module, or a compressor stage, for example, with blades applied to the disk.

The invention applies to any type of turbomachine, and in particular to a turbojet, the latter being either a single flow or bypass type. These types of turbojets are well known to a person skilled in the art and will therefore not be additionally detailed in the present text.

With reference to FIG. 1, illustrating the rotor of a fan, the rotor disk 1 is driven in rotation around a longitudinal axis A by a fan shaft. The disk comprises at its outer periphery a circumferential alternation of teeth 10 and of grooves 20 which extend axially, i.e. in a direction substantially parallel to the axis A of the disk.

Blades 30 (shown in FIGS. 2A, 2B, 2C), the roots 31 whereof are capable of being engaged axially in the grooves 20 of the disk and retained radially by the teeth 10, extend radially around the disk.

Platforms 45 are generally provided on the disk 1, and extend circumferentially between each couple of adjoining blades.

With reference to FIG. 4, the rotor disk 1 is of the pin-shaped 2 type in that it comprises a pin 2 of said disk having a curved pin-head shaped profile which extends radially in the upstream direction from the axis of the disk. This curved pin-head shaped profile is a substantially C-shaped profile comprising an exterior axial arm which delimits the teeth 10 of the disk, an interior arm which extends at least over a component substantially closer axially to the engine axis than the exterior arm, and a front connecting arm with a radial component, which conventionally comprises a prominence 40.

Vertically in line with each groove 20, on the prominence 40 of the disk pin is provided an attachment element 41 of an upstream shroud 43 to the disk 1, an implementation example whereof is shown in FIG. 4. The attachment element 41 of the shroud 43 is generally in the form of a hook equipped with an orifice 42 allowing the attachment of the shroud 43 to the pin 2 of the disk 1 by screwing. The shroud 43 is connected further upstream to an upstream cone 44 forming the inner and upstream limit to a circulation stream of fluid in the turbomachine.

FIGS. 2A, 2B and 2C illustrate a portion of a rotary assembly, centered on a groove 20 of the disk 1, one blade 30 whereof inserted in the groove 20 is retained axially by the retention system according to the invention, as well as the mounting of such a retention system on the upstream face of the rotor disk 1. Thus, the structure of the retention system and its mounting method on the disk will be described in parallel.

It is specified that "axial retention" signifies that the blade is immobilized axially thanks to the retention system, and that any displacement along the longitudinal axis A of the rotor disk is henceforth made impossible.

In FIG. 2A, a blade 30 is mounted on the rotor disk 1 by insertion of its root 31 in the corresponding groove 20 of the disk. The groove has a flared shape, and is limited circumferentially by two consecutive teeth 10 of the disk. It extends axially along the rotor disk, and comprises a bottom 21, bordered by two edges 22 common with the teeth 10, as well as an opening 23 which constitutes the upstream axial end of the groove 20 and the bottom 21 whereof is situated in the vicinity of the disk pin 2.

The blade root 31 has a flared shape corresponding substantially to the shape of the groove 20 in which it is inserted. It is formed by two sides 32 which extend axially facing the edges 22 of the groove 20, by an upstream front 33 connecting the two sides 32, as well as a base 34 which extends axially, facing the bottom 21 of the groove. The blade root 31 is mounted in the groove so that its upstream front 33 is situated in the plane P of the rotor disk 1, orthogonal to the axis A of the disk, and containing the ends 13 of the teeth 10. In other words, the upstream front 33 of the blade root 31 and the ends 13 of the teeth 10 have substantially the same axial position.

A tooth 10 extends axially along the external periphery of the disk 1 and comprises two side edges 11 common with the edges of the grooves 20 which it delimits. The edges 20 of the tooth are connected by an upper face 12 and terminate axially by an end 13. Thus, the opening 23 of the groove is bordered by the ends 12 of the teeth 10. In particular, the upstream front 33 of the blade root, the opening 23 of the groove, and the ends 13 of the teeth are situated in the plane P of the rotor disk 1.

The ends 13 are upstream axial ends in the form of a surface on which the retention system is able to be mounted, in conformity with what follows.

The teeth 10 advantageously comprise trenches 14 which extend along their upper face 12, serving for accommodating platforms 45. It will be understood that such trenches are optional, as are the platforms which they accommodate.

With reference to FIG. 2B, the lock 501 of the retention system is pressed against the ends 13 of the teeth of the disk 1 so as to block the opening 23 of the groove. In doing so, the lock 501 bears against the upstream front 33 of the blade root 31. The lock thus prevents the blade root from leaving the groove by the opening by an axial displacement. It will be noted that the blockage of the opening 23 by the lock 501 is at least partial, and should be sufficient to prevent the blade root from passing through the opening.

According to the embodiment of the rotary assembly shown in FIG. 2B, the lock 501 is in the form of a part comprising a central portion 511 from which the edges 521 extend. Thus, when the lock 501 is in place, the central portion 511 of the lock blocks the opening 23 of the groove 20 and bears against the upstream front 33 of the blade root, and the edges 521 of the lock bear against the ends 13 of the teeth 10.

With reference to FIG. 2C, when the lock 501 is in place, removable parts 502 are mounted at the ends 13 of the teeth, bearing against the lock 501, so as to block said lock. The removable parts 502 then constitute the new ends of the teeth on which they are mounted.

Advantageously, the removable parts 502 protrude from the rotor disk 1.

The parts are said to be "removable" in that they may be separated from the ends of the teeth or attached to said ends of the teeth, by any means provided for this purpose.

The lock is said to be "blocked" in that it is held immobile, clamped between the ends of the teeth and the removable parts.

According to the embodiment of the rotary assembly shown in FIG. 2C, the edges 521 of the lock 501 bear both against the ends 13 of the teeth, on the side of the downstream surface of the lock, and against the removable parts 502, on the side of the upstream surface of the lock.

Henceforth, the blade 30 is retained axially, in position in its groove 20, by the retention system according to the invention.

Advantageously, it is also possible to provide retention means allowing the lock 501 to be retained in position against the ends 13 of the teeth during mounting of the removable parts 502.

Moreover, the shape (or cross-section) of the lock is not limited to the substantially pentagonal shape shown in FIGS. 2B and 2C. The shape and the dimensions of the lock will be advantageously selected so as to allow complete blockage of the opening 23 of the groove 20. Special care will be taken that the edges 521 of the lock are sufficiently pronounced to obtain sufficient and stable abutment of the edges of the lock against the ends 13 of the teeth, so as to avoid having the lock pivot or rocks on itself, and is not accidentally detached from the disk 1.

The lock may optionally comprise a nose 541 allowing its gripping by a user to be facilitated and thus facilitating its installation or its removal, and may be provided with an orifice 551 so as to attach an underlying wedge 60 described hereafter.

Preferably, when a removable part 502 is mounted at the end 13 of a tooth, it completely eclipses said end of the tooth. In an additionally preferred manner, the shape (or cross-section) of a removable part corresponds to the shape of the end of the tooth on which it is mounted, so as to prolong the tooth continuously. Thus, the removable part 502 comprises particularly trenches 552 corresponding to those of the teeth 10. This complementary nature of the shapes advantageously allows a tooth to be obtained, when the removable part is mounted at its end, the structure whereof is substantially similar to the prior art, with of course the exception of the removable nature of its end, which offers the advantage in particular of being able to implement the retention system according to the invention on preexisting rotor disks by cutting the ends 13 of the protruding teeth so as to obtain removable parts 502.

However, it will also be possible to provide other embodiments concerning the shape of the removable parts, particularly annular, square or triangular parts, for example.

According to the embodiment illustrated in FIG. 3, the removable part 502, once mounted on one end 13 of a tooth 10, bears against said end 13 of the tooth. To accomplish this, the removable part 502 comprises two side edges 522, and a central portion 512 protruding on the downstream surface of the part, so as to form lateral shrinkages 532. Thus, when the removable parts 502 are mounted against the lock 501, the central portion 512 of each removable part bears against the end 13 of the corresponding tooth, and the lateral shrinkages 532 of the removable parts 502 bear against the edges 521 of the lock 501.

Moreover, optionally, a wedge 60 is inserted in the groove 20, between the bottom 21 of the groove and the base 34 of the blade root. When the lock 501 is in place, the wedge 60 is situated below the lock, i.e. between the periphery of the disk and the lock. The wedge 60 allows a force to be exerted on the blade root 31 directed radially toward the exterior of the disk, thus pushing the sides 32 of the blade root against the side edges 22 of the groove, which limits the movement of the blade with respect to the disk, and most particularly the radial displacement of the blade and the rotation of the blade around the axis of its root (circumferential displacement). The wedge 60 may be equipped with an opening so as to be attached to the nose 541 of the lock 501 by an orifice 551, by means of a rod for example.

The removable parts 502 and the ends 13 of the teeth advantageously include attachment means allowing said removable parts to be connected to said ends of the teeth. Preferably, the attachment means comprise respectively a first axial orifice 542 provided on the removable parts 520 and a second axial orifice 15 provided in the ends 13 of the teeth. When the removable parts 502 are mounted on the ends 13 of the teeth, the first 542 and the second 15 orifices are aligned, and are designed to receive a rod so as to attach the removable parts to the end of the teeth.

For this same purpose, the teeth 10 may also comprise a third orifice 16 on their upper face 12, in the vicinity of their end 13, said third orifice 16 being orthogonal to the second orifice 15, leading to the second orifice, and being capable of receiving for example a barrel nut.

A retention system suitable for preventing the rotation of the removable parts 502 around the axis of the rod inserted into the orifice 542 which connects them to the end 13 of the teeth is advantageously provided. It is possible to consider any known means of angular indexing allowing prevention of the rotation of the removable parts 502. There are for example two additional orifices provided respectively in the removable parts and in the ends of the teeth, parallel to the foregoing first orifice 542 and to the second orifice 15, and a rod housed in said additional orifices. The removable parts may also comprise a shoulder bearing against the upper face 12 of the teeth 10.

One advantage of the retention system according to the invention is that it allows the space situated in the periphery of the disk, on the pin 2 of the disk when the latter is shaped like a pin, usually necessary for the insertion or for the removal of the lock at the opening 23 of the groove 20, to be made usable.

Consequently, the retention system allows the dimensioning constraints, connected with the positioning of the attachment element 41 of the shroud to the disk 1, provided on the prominence 40 of the pin 2 of the disk, to be relaxed. The shroud-disk attachment element 41, and by extension the prominence 40, may in fact be positioned higher on the pin of the disk, at the periphery of the disk, i.e. farther from the center of the disk, as illustrated by the arrow 46 of FIG. 4.

Taking up again the current embodiment of the attachment of the shroud 43 to the pin 2 of the disk, the prominence 40 protruded from the disk 1. The prominence 40 comprises an attachment element 41 which is advantageously in the form of a hook and which is provided with an orifice 42 for attaching the shroud to the disk 1. The arrow 46 indicates that the hook of the attachment element 41 is positioned higher on the pin 2 of the disk, i.e. farther away radially from the center of the disk, with respect to existing ones.

It will be understood that the element 41 for attaching the shroud 43 to the disk 1 is not limited to the hook illustrated in FIG. 4.

The retention system according to the invention thus allows the cantilever of the shroud (or the "clearance" of the shroud), which corresponds to the portion D of the shroud which extends from the attachment element 41 (from the prominence 40) to its external periphery (in FIG. 4, this is the "high" portion of the shroud), to be reduced. The moment between the attachment of the shroud and the external periphery of the shroud is thus reduced.

The result is two main effects for the rotary assembly of the turbomachine equipped with the blade retention system according to the invention:

A gain in aerodynamic performance, by limitation of the radial displacements of the shroud, and by extension of the platform attached to the shroud.

An improvement in mass, in that it is possible to reduce the thickness and therefore the mass of the shroud, due to a smaller prerequisite strength of the shroud because the latter is less mechanically stressed.

REFERENCES

FR2974864

U.S. Pat. No. 6,634,863

The invention claimed is:

1. A turbomachine rotary assembly, comprising:

a rotor disk comprising circumferentially an alternation of peripheral teeth and grooves, said grooves being provided with an opening bordered by ends of the teeth, a plurality of blades having roots positioned in the grooves, and an axial retention system of said blades, wherein the axial retention system comprises a removable lock mounted bearing against upstream axial ends of two consecutive teeth of the disk so as to block the opening of the groove formed by said teeth, the lock being in a form of a part comprising a central portion from which extend edges, wherein said central portion blocks the opening of the groove and is adapted to bear against an upstream front of the root of the blade when the lock is in place, the edges of the lock bearing against the ends of the teeth, and removable parts suitable for being mounted at the upstream axial ends of the teeth thereby blocking the lock by clamping the edges of said lock between said removable parts and the teeth once the lock is installed against the upstream axial ends of the teeth.

2. The rotary assembly according to claim 1, wherein the removable parts have a shape corresponding to a shape of the ends of the teeth on which the removable parts are mounted, so as to continuously prolong the teeth.

3. The rotary assembly according to claim 1, wherein the removable parts are mounted at the ends of the teeth by screwing.

4. The rotary assembly according to claim 1, wherein the rotor disk comprises a pin having a curved pin-head shaped profile which extends radially in an upstream direction from an axis of the rotor disk, the removable parts protrude from the rotor disk and are vertically in line with a prominence of the pin of the rotor disk.

5. The rotary assembly according to claim 4, wherein the prominence of the pin of the rotor disk is provided with an attachment element of a shroud to the rotor disk so that the lock is mounted vertically in line with the attachment element of the shroud to the rotor disk.

6. The rotary assembly according to claim 4, wherein between the prominence of the pin of the rotor disk and the teeth, the pin of the rotor disk has no space for at least one of insertion or removal of the lock.

7. A turbomachine comprising:

one or more rotary assemblies comprising at least one axial retention system of a blade of the rotor disk according to claim 1.

8. A mounting method of an axial retention system of a blade on a turbomachine rotary assembly according to claim 1, the rotary assembly comprising a rotor disk provided circumferentially with an alternation of peripheral teeth and grooves, said grooves being provided with an opening bordered by the ends of the teeth, and at least one blade the root whereof is inserted in one of said grooves, the mounting method comprising:

mounting of a lock bearing against the ends of the teeth, so as to block the opening of the groove, and mounting of the removable parts at the ends of the teeth so as to block the lock by clamping said lock between said removable parts and the teeth.

9. The rotary assembly according to claim 1, wherein each of the removable parts includes two side edges and a central portion protruding on a downstream surface of the removable part so as to present lateral shrinkages, and when the removable parts are mounted to block the lock, the lateral shrinkages bear against the edges of the lock.

* * * * *